United States Patent [19]

Kenma

[11] 4,347,196

[45] Aug. 31, 1982

[54] CARBURETOR EQUIPPED WITH AN AUTO-CHOKE DEVICE

[75] Inventor: Shigeyuki Kenma, Ibaraki, Japan

[73] Assignee: Hitachi, Ltd., Tokyo, Japan

[21] Appl. No.: 114,969

[22] Filed: Jan. 24, 1980

[30] Foreign Application Priority Data

Jan. 24, 1979 [JP] Japan ..... 54-6058

[51] Int. Cl.[3] ..... F02M 1/14

[52] U.S. Cl. ..... 261/39 B; 91/24; 91/52; 91/394; 261/DIG. 74

[58] Field of Search ..... 261/39 B, DIG. 74; 91/24, 52, 394

[56] References Cited

U.S. PATENT DOCUMENTS

| | | | |
|---|---|---|---|
| 2,602,429 | 7/1952 | Worster | 91/52 |
| 2,884,905 | 5/1959 | Jensen | 91/52 |
| 2,929,226 | 3/1960 | Baker et al. | 261/39 B |
| 3,251,274 | 5/1966 | Jensen | 91/52 |
| 3,364,818 | 1/1968 | Hager et al. | 91/24 |
| 3,380,349 | 4/1968 | James | 91/394 |
| 3,872,847 | 3/1975 | Charron et al. | 261/39 B |
| 3,934,565 | 1/1976 | Matsumoto et al. | 261/39 B |
| 4,119,683 | 10/1978 | Tamura | 261/39 B |
| 4,138,978 | 2/1979 | Morikawa et al. | 261/39 B |
| 4,178,895 | 12/1979 | Benjamin | 261/39 B |

FOREIGN PATENT DOCUMENTS

| | | | |
|---|---|---|---|
| 52-67421 | 3/1977 | Japan | 261/39 B |

*Primary Examiner*—Tim R. Miles

*Attorney, Agent, or Firm*—Craig and Antonelli

[57] ABSTRACT

A carburetor equipped with an auto-choke device is disclosed wherein according to one embodiment a leak valve is disposed in a negative pressure chamber of a diaphragm device adapted to operate by a negative pressure in a suction passage downstream of a throttle valve so as to open a choke valve in said suction passage to a predetermined degree of opening (complete explosion opening) after an engine has rotated by itself, and when the diaphragm has executed a predetermined shift, the leak valve is opened, and simultaneously, the downstream of the leak valve is brought into the atmospheric pressure for engine temperatures below a set value and into the same negative pressure as that of the negative pressure chamber for engine temperatures at and above the set value, whereby the operating stroke of the diaphragm is changed-over in two stages in dependence upon the water temperature or oil temperature, and the complete explosion opening of the choke valve is changed-over in two stages so that it may become narrow when the water temperature or oil temperature is low and wide when it is high.

5 Claims, 2 Drawing Figures

CARBURETOR EQUIPPED WITH AN AUTO-CHOKE DEVICE

BACKGROUND OF THE INVENTION

1. Field of the Invention

This invention relates to a carburetor for use in an internal combustion engine. More particularly, it relates to a carburetor equipped with the so-called auto-choke device wherein the degree of opening of a choke valve is automatically controlled by a thermosensitive member during the idling of the engine.

2. Description of the Prior Art

In an auto-choke device of a carburetor as has been generally known, in order to improve the starting of an engine, that is, in order to enhance the ignitability of a mixture within a combustion chamber, a choke valve of the carburetor is closed by a thermosensitive member so as to supply a thick mixture to the engine.

When the engine has started rotating by itself, the aforecited mixture is too thick. Therefore, a suction negative pressure generated downstream of a throttle valve of the carburetor is applied to a diaphragm device mechanically interlocked with the choke valve, whereby the choke valve is forcibly opened to a predetermined degree of opening called the degree of complete explosion opening, so as to form a mixture at a density suitable for continuing the subsequent rotation of the engine. This mechanism is known as what is called the complete explosion-correction mechanism.

This type of auto-choke device of the carburetor is used in a state of very low temperatures of and below −7° C. and in a state of ordinary low temperatures such as +15° C. Nevertheless, the complete explosion opening is fixed for the very low temperature state and the ordinary low temperature state in the complete explosion-correction mechanism as described above, and there have been the following problems:

(1) When the complete explosion opening has been set in conformity with the very low temperature state, the mixture to be supplied during the continuous running becomes unnecessarily thick in the ordinary low temperature state, and noxious components in an exhaust gas increase conspicuously. Further, it is sometimes the case that the mixture thickens beyond the inflammability limit, that the continuous running becomes difficult and that the engine stops. (2) Conversely, when the complete explosion opening has been set in conformity with the ordinary low temperature state, the mixture is too thin in the very low temperature state, and the continuous running is hindered.

In order to eliminate these drawbacks, there have been proposed an apparatus wherein two diaphragm devices are interlocked with a choke valve, the stroke of one of the diaphragm devices is made greater than that of the other diaphragm device, and the diaphragm devices are selectively used, whereby the complete explosion opening is controlled in two stages so as to get rid of the drawbacks, and an apparatus wherein as disclosed in U.S. Pat. No. 3,872,847, a diaphragm device is provided with a bimetal, whereby the complete explosion opening is controlled so as to get rid of the drawbacks.

With the former expedient, however, the selective use of the two diaphragm devices leads to the problems that the number of components becomes large and that the carburetor itself becomes large and complicated. The latter expedient has the problems that since the bimetal is exposed to the exterior, it is liable to be handled by mischief, and that an accurate degree of complete explosion opening cannot be attained by only the force of the bimetal.

SUMMARY OF THE INVENTION

Object of the Invention

An object of this invention is to provide a carburetor equipped with an auto-choke device capable of attaining a complete explosion opening suited to the very low temperature state and a complete explosion opening suited to the ordinary low temperature state; the carburetor being small in the number of components and simple in construction, being capable of attaining accurate degrees of complete explosion openings and being free from the fear of mischief.

BRIEF SUMMARY OF THE INVENTION

This and other objects, features and advantages are achieved according to the present invention by providing in a carburetor equipped with an auto-choke device for an internal combustion engine, comprising a choke valve arranged in a suction passage of said carburetor and a throttle valve arranged in said suction passage downstream of said choke valve, the improvement comprising vacuum motor means responsive to a negative pressure generated downstream of said throttle valve for opening said choke valve to a predetermined first degree when the engine temperature is below a set temperature and to a predetermined second degree which is greater than said first degree when the engine temperature is at or above said set temperature, said vacuum motor means including a negative pressure chamber into which said negative pressure generated downstream of said throttle valve is introduced, and means for communicating said negative pressure chamber with atmospheric pressure to prevent said vacuum motor means from opening said choke valve to said second degree of opening from said first degree of opening when the engine temperature is below said set temperature.

According to a preferred embodiment of the present invention, the vacuum motor means is a diaphragm device constituting a complete explosion-correction mechanism provided with a leak valve which is driven by the operation of a diaphragm of the diaphragm device when the diaphragm has been moved to a predetermined position by a negative pressure developing downstream of a throttle valve, and the downstream of the leak valve is subjected to the atmospheric pressure for engine temperatures below a set valve and to the suction negative pressure for engine temperatures of or above the set value, so as to make the complete explosion opening narrow for the engine temperatures below the set value and to make it wide for the engine temperatures of or above the set value.

BRIEF DESCRIPTION OF THE DRAWINGS

FIG. 1 is a constructional view of a carburetor equipped with an auto-choke device according to an embodiment of the present invention, while

DETAILED DESCRIPTION OF THE INVENTION

Figure 1:
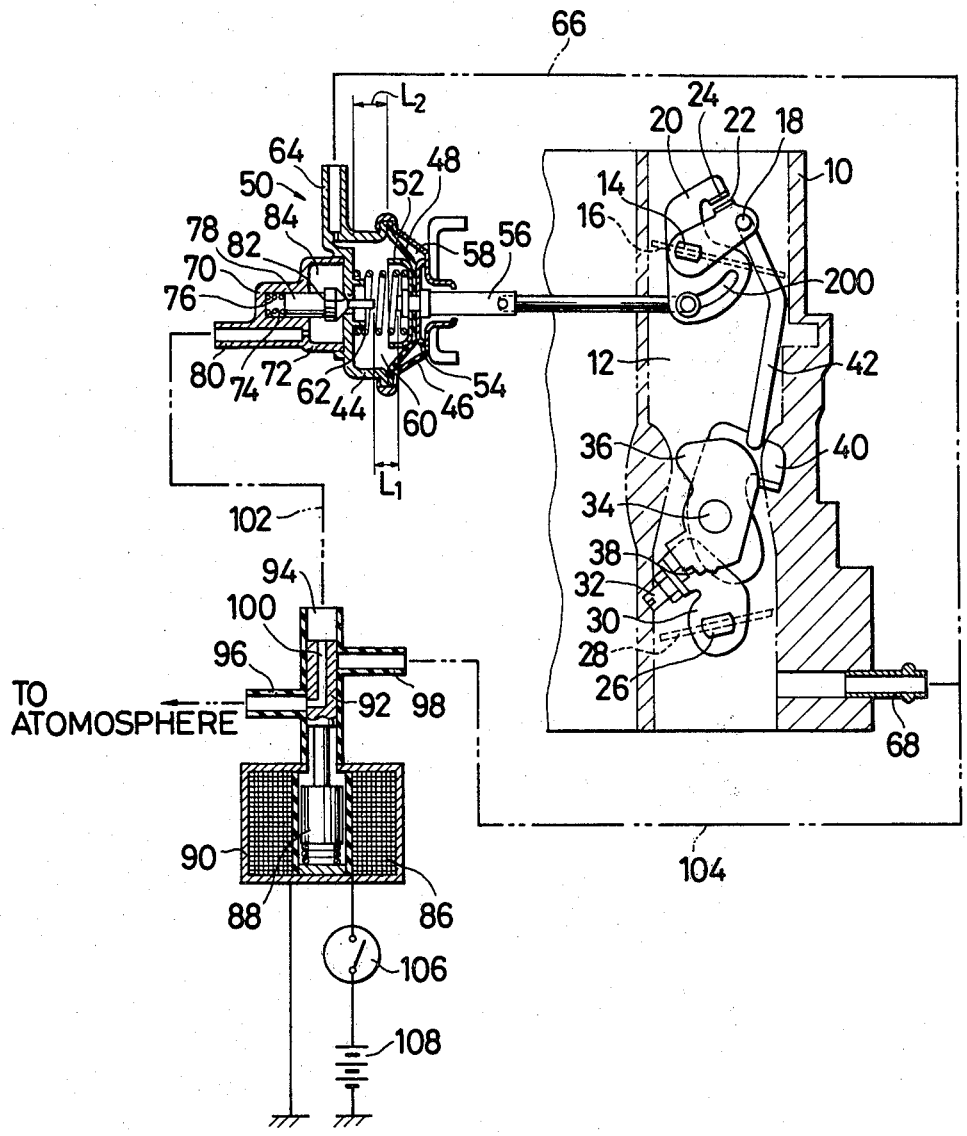

Reference numeral 10 designates a carburetor proper or body, in which a suction passage 12 is formed. In the suction passage 12, a choke valve 16 fixed to a choke shaft 14 is arranged. A choke lever 18 is turnably supported to the choke shaft 14, and a choke piston lever 20 is fixed to the choke shaft 14. The choke lever 18 and the choke piston lever 20 are respectively formed with abutting portions 22 and 24.

A throttle valve 28 fixed to a throttle shaft 26 is arranged downstream of the choke valve 16. A throttle lever 30 is fixed to the throttle shaft 26, and an adjust screw 32 is in engagement with a part of the former. Numeral 34 designates a fast idle cam shaft, round which a fast idle cam 36 is turnably supported. At a partial peripheral edge of the fast idle cam 36, a plurality of cam stages 38 are formed. The cam stage 38 is in contact with the adjust screw 32, and the degree of opening of the throttle valve during idling is determined by the cam stage 38 and the adjust screw 32. A counter lever 40 is fixed to the fast idle shaft 34, and is interlocked with the choke lever 18 by a connecting rod 42. The construction thus far described is an interlocking mechanism for the choke valve 16 and the throttle valve 28.

Now, a complete explosion-correction mechanism will be described. Reference numeral 50 designates a vacuum motor in the form of a diaphragm device which constitutes the complete explosion-correction mechanism, and in which a diaphragm 48 is held between a case 44 and a case 46. One end of a piston rod 56 is fixed to the diaphragm 48 by retainers 52 and 54, while the other end of the rod 56 is in engagement with a slot 200 formed in the choke piston lever 20. An atmospheric air chamber 58 is defined by the case 46 and the diaphragm 48, and a negative pressure chamber 60 by the case 44 and the diaphragm 48. A compression spring 62 is interposed in the negative pressure chamber 60, and it is urged in a direction in which the choke valve 16 is closed by the piston rod 56 through the retainer 52 and the diaphragm 48. Further, the negative pressure chamber 60 communicates downstream of the throttle valve 28 through a nipple 64, a negative pressure passage 66 and a nipple 68 so as to introduce a suction negative pressure.

On the other hand, a leak valve assembly 70 is fixed to the case 44 of the diaphragm device 50. The leak valve assembly 70 is constructed of a case 72, a leak valve 78 which is inserted through a compression spring 76 in a cylindrical hole 74 formed inside the case 72, and a nipple 80. When the case 72 is fastened to the case 44, the leak valve 78 penetrates into an aperture 82 provided in the case 44, up to an intermediate position of the aperture so as to cut off the communication between the negative pressure chamber 60 and a leak chamber 84. Here, when the leak valve 78 moves leftwards as viewed in the figure against the spring 76, the negative pressure chamber 60 and the leak chamber 84 are brought into communication.

Now, a pressure change-over mechanism will be described. Reference numeral 90 designates an electrical pressure change-over valve, in which a movable core 88 is slidably arranged inside a coil 86. A valve 92 is fixed to the top end of the movable core 88, and it is constructed so as to bring a nipple 94 into communication with either of a nipple 96 and a nipple 98. More specifically, under a state under which the coil 86 is not energized, the nipple 94 is held in communication with the nipple 96 through an L-shaped passage 100 of the valve 92. Upon energization of the coil 86, the movable core 88 is attracted to bring the nipple 94 and the nipple 98 into communication. The nipple 94 communicates with the nipple 80 through a negative pressure passage 102, while the nipple 98 communicates with the nipple 68 through a negative pressure passage 104. The coil 86 is connected with a power supply 108 through a temperature switch 106. The temperature switch 106 serves to detect the temperature of an engine such as the temperature of cooling water.

The operations of the auto-choke device in a very low temperature state and in an ordinary low temperature state will be described below.

[Ordinary low temperature state] (at and near +15° C.)

Under this state, an accelerator pedal is first trodden in. Then, the throttle valve 28 is opened, and the choke valve 16 is fully closed owing to a thermosensitive member (not shown). At this time, the fast idle cam 36 is turned counterclockwise by the choke lever 18, connecting rod 42 and counter lever 40 to a position in which the adjust screw 32 and the highest cam stage 38 of the fast idle cam 36 are in engagement. When the accelerator pedal is released, the choke valve 16 remains fully closed, and the throttle valve 28 determines the position of the fast idle opening. This state is the positional relation of the choke valve 16—the throttle valve 28 immediately before starting.

Subsequently, when a starter is turned in order to start the engine, a thick mixture is supplied to the engine because of the full closure of the choke valve 16, whereby the engine rotates by itself. A suction negative pressure having developed downstream of the throttle valve 28 at this time is introduced into the negative pressure chamber 60 of the diaphragm device 50 through the nipple 68, negative pressure passage 66 and nipple 64. When the negative pressure acts on the diaphragm 48, the diaphragm 48 moves leftwards as viewed in the figure against the spring 62. Therewith, the piston rod 56 moves leftwards and operates so as to open the choke valve 16 through the choke piston lever 20. When the diaphragm 48 has moved a predetermined distance $L_1$, the leak valve 78 and the fore end part of the piston rod 56 come into contact, and the leak valve 78 is opened so as to bring the negative pressure chamber 60 and the leak chamber 84 into communication. Here, when the temperature of the cooling water is, for example, at or above +5° C., the temperature switch 106 turns "on" to cause current to flow through the coil 86. Thus, the movable core 88 moves downwards as viewed in the figure, to bring the nipples 94 and 98 into communication and to bring the negative pressure passages 102 and 104 into communication. Accordingly, the negative pressure in the downstream of the throttle valve 28 is introduced from the nipple 68 into the leak chamber 84. Therefore, the diaphragm 48 is further shifted leftwards as viewed in the figure by being pushed by the atmospheric air in the atmospheric air chamber 58. When it has been shifted a distance $L_2$, it stops at the position. The choke valve 16 is opened a degree of opening corresponding to the distance $L_2$. This degree of opening is the complete explosion-opening at the ordinary low temperature, and the choke valve 16 is opened comparatively widely.

Subsequently, as the engine temperature rises, the thermosensitive member opens the choke valve 16 gradually. At this time, only the counter lever 40 follows up the motion and turns clockwise. When the choke valve 16 has been opened to a certain degree of opening, the accelerator pedal is trodden in. Then, the throttle valve 28 is opened, and the fast idle cam 36 is disengaged from the adjust screw 32. The fast idle cam 36 is turned clockwise by a spring, not shown, until it comes into contact with the counter lever 40 and then stops. When the accelerator pedal is released here, the adjust screw 32 comes into contact with the lower cam stage 38 of the fast idle cam 36, whereby the throttle valve 28 comes closer to the idle opening. By repeating such operations, the idle running is completed.

[Very low temperature state] (at and near −7° C.)

The operation in this state until the engine rotates by itself is the same as in the case of the ordinary low temperature state.

When the engine has begun to rotate by itself, the suction negative pressure having developed downstream of the throttle valve 28 is introduced into the negative pressure chamber 60 of the diaphragm device 50 through the nipple 68, negative pressure passage 66 and nipple 64. Under the action of the negative pressure on the diaphragm 48, the diaphragm 48 moves leftwards as viewed in the figure against the spring 62. With the leftward movement of the diaphragm, the piston rod 56 moves leftwards and operates so as to open the choke valve 16 through the choke piston lever 20. When the diaphragm 48 has moved the predetermined distance $L_1$, the leak valve 78 and the fore end part of the piston rod 56 come into contact, and the leak valve 78 is opened so as to bring the negative pressure chamber 60 and the leak chamber 84 into communication.

In case where the temperature of the cooling water is below +5° C., the temperature switch 106 is "off" and no current flows through the coil 88, so that the nipple 94 and the nipple 96 communicate through the L-shaped passage 100 of the valve 92.

Accordingly, the atmospheric air is introduced into the leak chamber 84 through the nipple 96, L-shaped passage 100, nipple 94, negative pressure passage 102 and nipple 80. Owing to the consequent introduction of the atmospheric air into the negative pressure chamber 60, the pressures of the negative pressure chamber 60 and the atmospheric air chamber 58 are balanced, and the diaphragm 48 is moved rightwards by the spring 62. However, when the diaphragm 48 has passed through the extent of the distance $L_1$, the leak valve 78 cuts off the communication between the leak chamber 84 and the negative pressure chamber 60 again, so that the negative pressure chamber 60 becomes the negative pressure again to cause the diaphragm 48 to shift leftwards. By repeating such operations, the diaphragm 48 is apparently stationary in the form in which it has moved approximately the distance $L_1$. Accordingly, the choke valve 16 opens an angle which corresponds to the movement distance $L_1$ of the diaphragm 48. This angle is determined in advance to be a complete explosion opening adapted for the very low temperature state.

Thereafter, when the temperature of the cooling water has reached +5° C. owing to the rise of the engine temperature, the temperature switch 106 turns "on", and hence, the nipple 94 communicates with the nipple 98. The same operation as in the ordinary low temperature state is performed, and the idling is completed.

Figure 2:
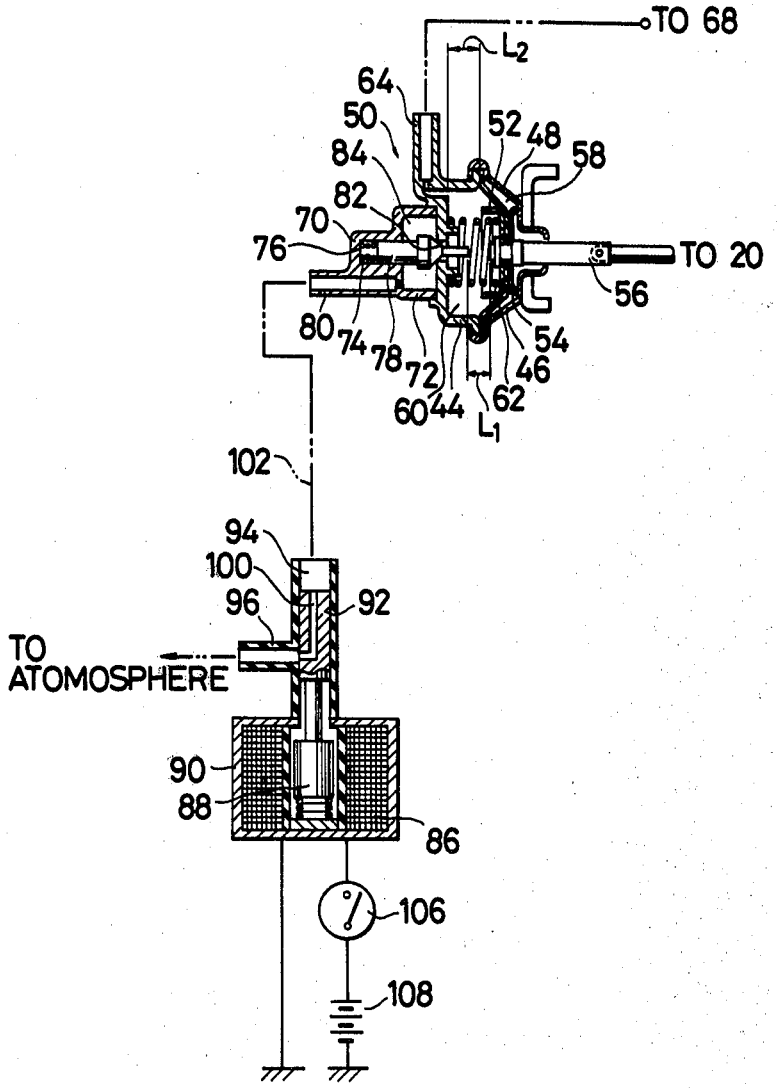
FIG. 2 is a constructional view of a carburetor equipped with an auto-choke device according to a second embodiment of the present invention.

FIG. 2 shows another embodiment in which the nipple 98 is omitted. The nipple 94 is brought into communication with, and cut off from, only the nipple 96. In the very low temperature state, the temperature switch 106 is "off". Therefore, the nipple 94 communicates with the nipple 96 through the L-shaped passage 100, and the same operation as in the very low temperature state above described is conducted. On the other hand, when the temperature switch 106 has turned "on", the movable core 88 moves downwards as viewed in the figure and cuts off the communication between the nipples 94 and 96 to establish a state in which the nipple 94 is shut up. In consequence, when the leak valve 78 has opened, the negative pressure from the nipple 64 does not leak at all. Thus, the diaphragm 48 conducts the same operation as in the ordinary low temperature state stated above. With the structure as shown in FIG. 2, the negative pressure passage 104 can be dispensed with, and the apparatus can be simplified.

In the above, the set temperature of the temperature switch 106 has been +5° C. in terms of the temperature of the cooling water. Needless to say, however, this value is not restrictive but any appropriate point can be selected. Of course, the portion to detect the temperature is not restricted to the cooling water, but temperatures such as the temperature of oil may be detected.

Further, the complete explosion openings of the choke valve in the respective states are appropriately selected depending upon the specifications of the engine.

As set forth above, according to this invention, the complete explosion opening of the carburettor choke valve can be corrected in the two stages in dependence upon the cooling water temperature or oil temperature of the engine in such a manner that the opening is narrow in the very low temperature state and wide in the ordinary low temperature state. Therefore, suitable mixtures necessary for the continuous running can be supplied to the engine in both the very low temperature state and the ordinary low temperature state, and the favorable continuous running of the engine can be realized irrespective of ambient temperatures. Further, the apparatus is constructed of the single diaphragm device including the leak valve, and the pressure change-over mechanism. Therefore, the number of components is small, and accurate degrees of complete explosion openings are obtained with the simple construction. In addition, it is not feared that the degrees of complete explosion openings will be changed by mischief.

What is claimed is:

1. In a carburetor equipped with an auto-choke device for an internal combustion engine, comprising a choke valve arranged in a suction passage of said carburetor and a throttle valve arranged in said suction passage downstream of said choke valve, the improvement comprising vacuum motor means responsive to a negative pressure generated downstream of said throttle valve for opening said choke valve to a predetermined first degree when the engine temperature is below a set temperature and to a predetermined second degree which is greater than said first degree when the engine temperature is at or above said set temperature, said vacuum motor means including a negative pressure chamber into which said negative pressure generated downstream of said throttle valve is introduced, and means for communicating said negative pressure chamber with atmospheric pressure to prevent said vacuum motor means from opening said choke valve to said second degree of opening from said first degree of opening when the engine temperature is below said set temperature, wherein said vacuum motor means includes a diaphragm which defines at least a portion of said negative pressure chamber and which is coupled to said choke valve by coupling means so as to open said choke valve when the negative pressure has been introduced into said negative pressure chamber, and wherein said means for communicating said negative pressure chamber with atmospheric pressure includes a leak valve means which introduces the negative pressure of said negative pressure chamber into a leak chamber when said diaphragm has shifted a first predetermined distance and opened said choke valve said predetermined first degree, means being provided for communicating said leak chamber with atmospheric pressure when the engine temperature is below said set temperature.

2. The carburetor according to claim 1, wherein said means for communicating said leak chamber with atmospheric pressure when the engine temperature is below said temperature is a pressure-change over mechanism which brings said leak chamber and the atmospheric air into communication when the engine temperature is below the set temperature, and which brings said leak chamber into communication with said suction passage downstream of the throttle valve when the engine temperature is at or above the set temperature so that said diaphragm can shift a second predetermined distance which is greater than said first predetermined distance and open said choke valve to said second degree.

3. The carburetor according to claim 1, wherein said means for communicating said leak chamber with atmospheric pressure when the engine temperature is below said set temperature is a pressure-change over mechanism which brings said leak chamber and the atmospheric air into communication when the engine temperature is below the set temperature, and which cuts off the communication between the leak chamber and the atmospheric air when the engine temperature is at or above the set temperature so that said diaphragm can shift a second predetermined distance which is greater than said first predetermined distance and open said choke valve to said second degree.

4. The carburetor according to claim 2 or 3, wherein said pressure change-over mechanism detects a temperature of cooling water.

5. The carburetor according to claim 1, wherein said negative pressure chamber is defined by said diaphragm and a first case, said leak chamber is defined by said first case and a second case, and said leak valve means engages an aperture porvided in said first case, in a manner to be capable of opening and closing said aperture.

* * * * *